US008185995B2

(12) United States Patent
Sjöberg

(10) Patent No.: US 8,185,995 B2
(45) Date of Patent: May 29, 2012

(54) PORTABLE SURFACE TREATING APPARATUS

(75) Inventor: Göran Sjöberg, Kungsängen (SE)

(73) Assignee: Aktiebolaget Electrolux, Stockholm (SE)

( * ) Notice: Subject to any disclaimer, the term of this patent is extended or adjusted under 35 U.S.C. 154(b) by 1999 days.

(21) Appl. No.: 10/517,027

(22) PCT Filed: Jun. 3, 2003

(86) PCT No.: PCT/SE03/00915

§ 371 (c)(1),
(2), (4) Date: Jul. 21, 2005

(87) PCT Pub. No.: WO03/105653

PCT Pub. Date: Dec. 24, 2003

(65) Prior Publication Data

US 2006/0010626 A1 Jan. 19, 2006

(30) Foreign Application Priority Data

Jun. 13, 2002 (SE) ..... 0201821-6

(51) Int. Cl.
*A47L 11/292* (2006.01)

(52) U.S. Cl. ..... 15/99

(58) Field of Classification Search ..... 15/99, 51
See application file for complete search history.

(56) References Cited

U.S. PATENT DOCUMENTS

| | | | | | |
|---|---|---|---|---|---|
| 848,974 | A * | 4/1907 | Crossman | 15/230.16 |
| 1,227,047 | A * | 5/1917 | Gray | 15/99 |
| 1,267,304 | A * | 5/1918 | Adams | 15/230.16 |
| 1,522,133 | A * | 1/1925 | Labiga et al. | 15/51 |
| 2,153,686 | A * | 4/1939 | Deegan, Sr. | 15/99 |
| 2,268,073 | A * | 12/1941 | Hunn et al. | 15/99 |
| 2,297,107 | A * | 9/1942 | Magnuson | 15/99 |
| 2,768,400 | A * | 10/1956 | Smillie et al. | 401/219 |
| 3,052,905 | A * | 9/1962 | McMillan et al. | 15/99 |
| 3,418,673 | A * | 12/1968 | Kruth | 15/118 |
| 3,909,869 | A * | 10/1975 | Hukuba et al. | 15/49.1 |
| 3,945,078 | A * | 3/1976 | Acquaro | 15/99 |
| 4,433,451 | A * | 2/1984 | Parisi | 15/321 |
| 4,646,380 | A * | 3/1987 | Kobayashi et al. | 15/41.1 |
| 4,845,794 | A * | 7/1989 | Korski et al. | 15/51 |
| 4,875,246 | A | 10/1989 | MacGregor | |
| 4,918,778 | A * | 4/1990 | Chupin et al. | 15/97.1 |
| 4,926,515 | A | 5/1990 | Lynn et al. | |
| 4,941,225 | A * | 7/1990 | Liao | 15/98 |
| 5,203,047 | A * | 4/1993 | Lynn | 15/99 |
| 5,933,900 | A * | 8/1999 | Wang | 15/50.3 |
| 6,223,378 | B1 * | 5/2001 | Watellier | 15/103.5 |
| 6,735,806 | B2 * | 5/2004 | Blum et al. | 15/104.002 |
| D531,766 | S * | 11/2006 | Ambasz et al. | D32/15 |
| 2004/0172769 | A1 * | 9/2004 | Giddings et al. | 8/148 |

FOREIGN PATENT DOCUMENTS

| | | |
|---|---|---|
| DE | 10025446 A1 | 11/2001 |
| WO | WO 02/39869 | 5/2002 |

* cited by examiner

*Primary Examiner* — Randall Chin

(74) *Attorney, Agent, or Firm* — Pearne & Gordon LLP

(57) ABSTRACT

A portable surface treating apparatus includes a shaft part (12) and a frame structure (22). The shaft part (12) has a handle part (13) that is capable of guiding the apparatus on the surface to be treated. The frame structure (22) has several rolls (29, 31) about which an endless conveyor belt (27) for liquid and dirt particles is arranged. A portion of the belt between the rolls is placed such that it is mainly parallel to the surface.

21 Claims, 4 Drawing Sheets

PORTABLE SURFACE TREATING APPARATUS

This application claims the benefit of International Application Number PCT/SE03/00915, which was published in English on Dec. 24, 2003.

BACKGROUND OF THE INVENTION

1. FIELD OF INVENTION

This invention relates to a portable surface treating apparatus comprising a shaft part with a handle part by means of which the apparatus can be guided on the surface to be cleaned and a frame structure having several rolls about which an endless conveyor belt for liquid and dirt particles is arranged.

2. DESCRIPTION OF RELATED ART

Apparatuses of the type mentioned above are previously known, see U.S. Pat. No. 4,926,515, and are used for wet cleaning of, for instance, floor surfaces. These apparatuses also comprise a container for dispensing cleaning liquid to the surface and a container for collecting dirty liquid which is picked up from the surface. The belt consists of a liquid absorbing material conveying the dirty liquid from the surface to the last mentioned container in which the liquid is removed from the conveyor belt by a squeezing means. This type of apparatus has, however, the drawback that the belt abuts the surface by line contact, which means that the absorption capacity decreases since the belt is squeezed by means of the compression forces when resting against the surface. Moreover, the apparatus can be hard to handle and guide because the driving motion of the belt is accomplished by means of manual measurements from the operator, i.e. by friction engagement between the belt and the surface.

It is also previously known, see U.S. Pat. No. 4,875,246, to use similar surface treatment apparatuses driven by electric motors and comprising a roll having an exterior surface of liquid absorbing material. The roll is driven by the electric motor and conveys the dirty liquid from the surface to a collecting container. Also, this apparatus has the drawbacks that are linked to line contact with the surface and the result is that too much water remains on the surface, which means long drying periods after the treatment.

Further, there are floor scrubbing machines having endless belts that operate with area contact, see for instance DE 10025446 A1, U.S. Pat. No. 3,945,078, and WO 02/39869 A1. Since these devices solely are provided with means for squeezing out the liquid from the belt, there is a considerable risk that dirt particles which are conveyed by the belt are not removed from the belt together with the liquid, but instead are re-deposited on the floor surface.

The purpose of this invention is to achieve a portable surface treating apparatus that conveys liquid as well as dirt particles from the surface to the collecting container and that does not have the drawbacks mentioned above. The apparatus is simple to handle and easy to guide at the same time as it safeguards a high degree of liquid removal from the surface such that it gets dry quickly. This is achieved by means of a device having the characteristics mentioned in the claims.

BRIEF DESCRIPTION OF DRAWINGS

An embodiment of the invention will now be described with reference to the accompanying drawings in which.

DETAILED DESCRIPTION OF THE INVENTION

Figure 1:
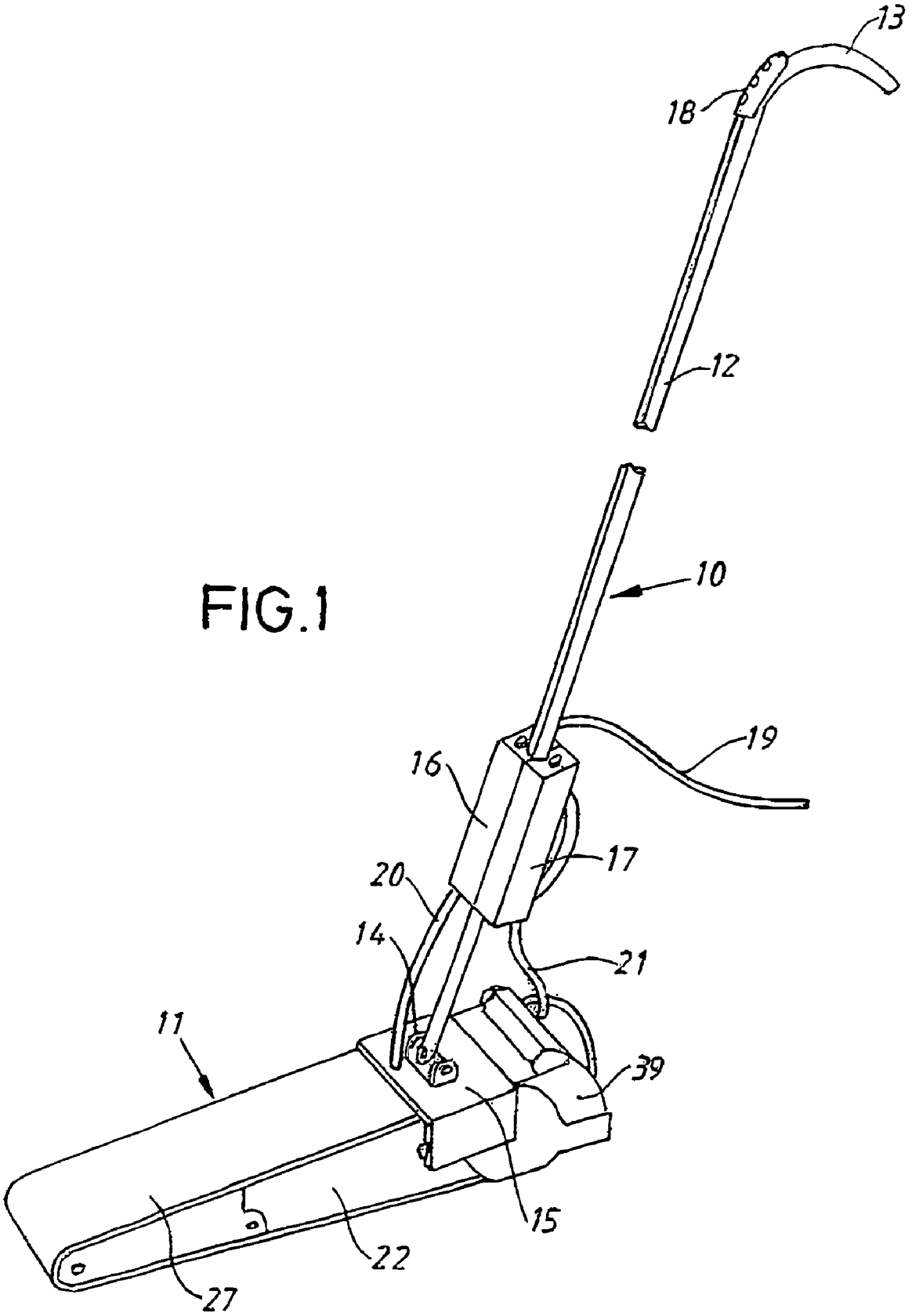
FIG. 1 is a perspective view of the surface treatment apparatus in question.

As appears from FIG. 1, the surface treatment apparatus comprises an upper part 10 and a lower part 11. The upper part comprises a shaft 12 with a handle 13. The lower end of the shaft continues via a link connection 14 into a bracket 15 in which the lower part 11 is removably secured in a manner not shown in detail. The shaft 12 supports two removably arranged containers, a first container 16 for a cleaning liquid and a second container for dirty liquid 17. The upper part 10 also is provided with a control panel 18 arranged close to the handle and by means of which the different functions of the apparatus can be controlled. The control panel is connected to an electric circuit, not shown, that is fed from mains supply via a cable 19. If desired, this current source may of course be replaced by a battery source.

The first container has a fill opening and one outlet, not shown, which is placed at the bottom and to which a valve is connected. The valve can be opened from the control panel 18 in order to let out the cleaning liquid through a hose 20 that is connected to a nozzle, not shown, at the bottom side of the bracket 15. The other container 17 for dirty liquid is by means of a hose 21 connected to the lower part 11 in a way that will be described below.

The lower part 11 comprises an elongated, slightly V-shaped, box shaped frame structure 22 comprising a front and a rear part 22*a* and 22*b*, respectively, that are turnably connected to one another about an axis 23. The frame structure 22 comprises two side walls 24 and an upper and a lower wall 25 and 26, respectively, that constitute flat elongated surfaces against which the inner side of an endless conveyor belt 27 rests. The conveyor belt comprises a supporting layer 27*a* on which a soft liquid absorbing layer, for instance a so called micro fibre layer, 27*b* is arranged. The supporting layer has a central ridge 27*c* directed inwardly and whose purpose will be explained below.

The front and rear part 22*a* and 22*b*, respectively, of the frame structure can, as has been described above, be turned with respect to one another between a first position where the parts are aligned with respect to one another and where the front part 22*a* is prevented from turning upwards with respect to the rear part 22*b* by means of co-operating abutting surfaces 28 to a second position where the front part 22*a* is folded down with respect to the rear part 22*b* such that the conveyor belt can be removed from the frame structure.

The frame structure 22 also supports a front roll 29 which is freely rotatable about a shaft 30 and a rear roll 31 rotatably arranged about a shaft 32. The frame structure 22 as well as the rolls 29, 31 are provided with central grooves 33, 34, 35 in which the ridge 27*c* of the belt runs. The frame structure 22 also encloses an electric motor 36 having a drive shaft 37 that via a belt transmission 38 transmits the rotation motion of the drive shaft to the rear roll 31. The frame structure 22 at its rear end also supports a container part 39 which is removably arranged at the frame structure 22 by means of two snap tongues 40 arranged one at each side of the frame structure.

Figure 3:
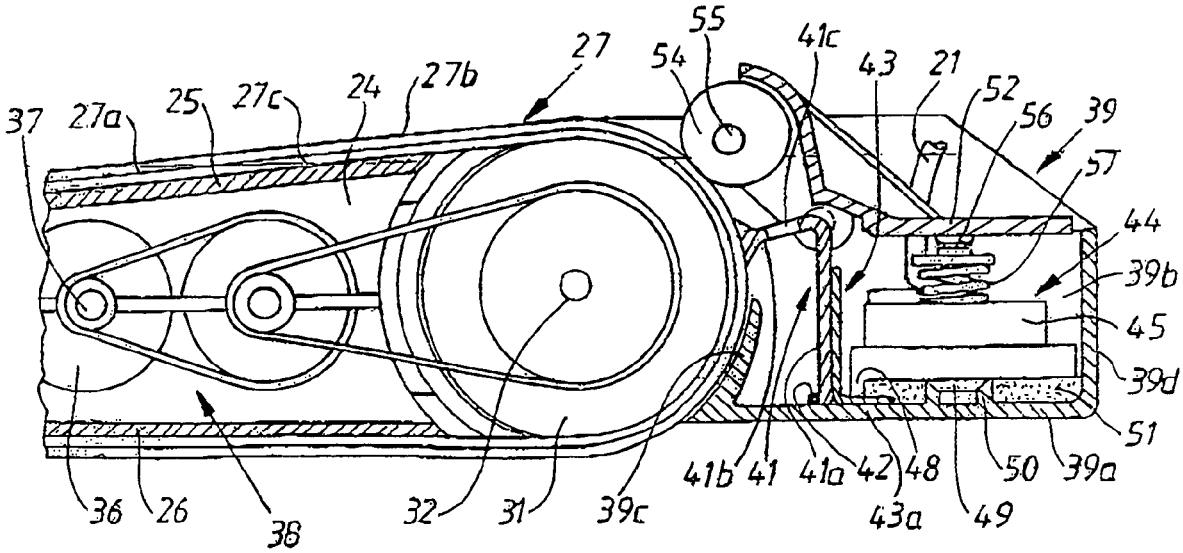
FIG. 3 is a vertical section through a part of said lower portion.
Figure 4:
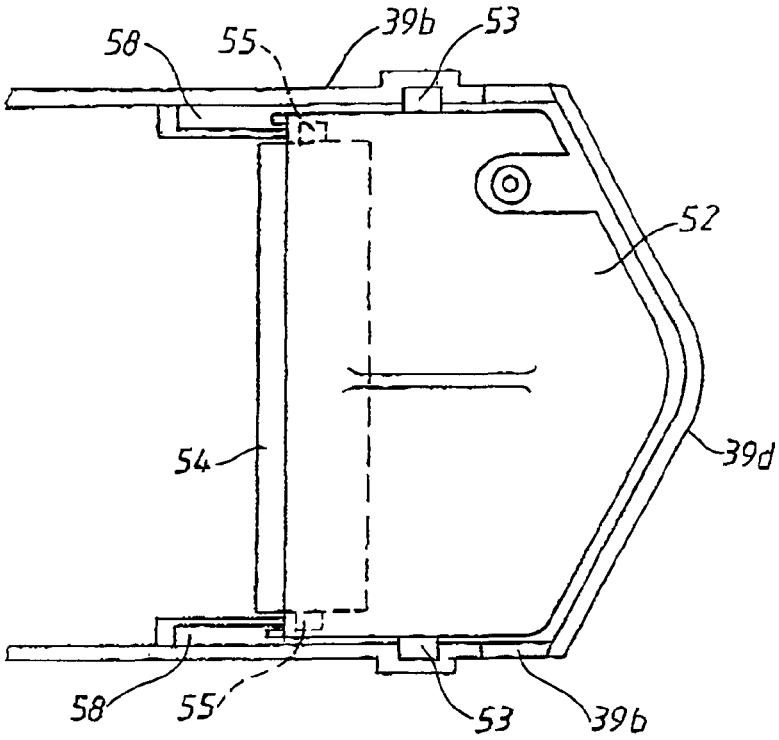
FIG. 4 is a plan view of a container part which is removably arranged at the rear part of the lower portion.
Figure 5:
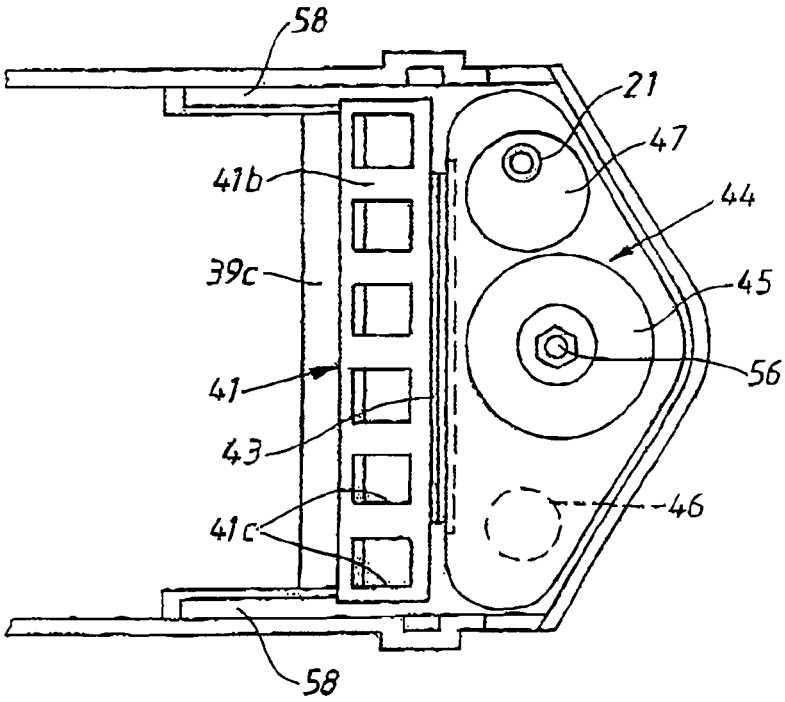
FIGS. 5 and 6 are the same views as FIG. 4, but the parts are partly demounted.
Figure 6:
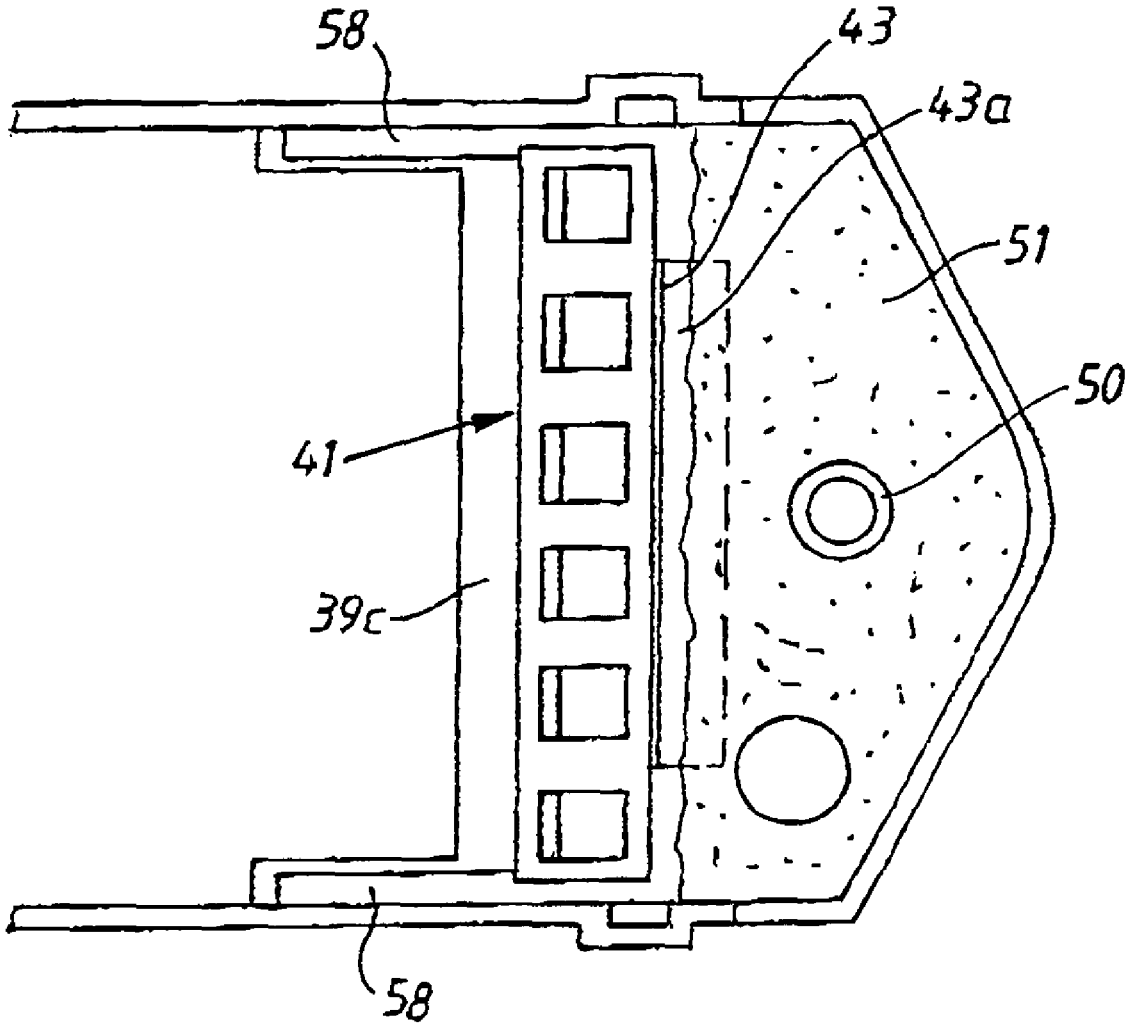

The container part 39 constitutes a container with a bottom 39*a*, side walls 39*b*, a front wall 39*c* and a rear wall 39*d*. The front wall 39*c* is shaped as a part of the exterior surface of a horizontal cylinder and is placed such that the distance between the outside of the wall 39*c* and the part of the conveyor belt 27 that rests against the roll 31 is successively decreased when the conveyor belt moves upwards in FIG. 3 together with the roll. The front wall is tapered such that the liquid following the belt will flow downwards, inwards towards the container. The bottom 39*a* of the container supports a removable scratching plate 41 which in section is L-shaped and which has a first leg 4*a* whose lower end is inserted between two dowels 42 such that the scratching plate can be turned about this end. The other leg 41*b* of the scratching plate has several openings 41*c* and the scratching plate 41 is additionally shaped such that the liquid which is present in the container can freely flow about or through it. The free end of the other leg 41*b*of the scratching plate is by means of spring pressure arranged to abut the conveyor belt 27 above the front container wall 39*c* the spring force being achieved by means of an L-shaped spring plate 43 that is connected to the first leg 41*a* and having an extending leg portion 43 *a*arranged to rest on the bottom 39*a* of the container.

The container part 39 encloses a removable pump housing 44 that is provided with a membrane pump 45 having an inlet 46 facing the bottom and an outlet, not shown, that via a check valve 47 is connected to a nipple on which the hose 21 is applied. The front part of the pump housing 44 has a flange 48 that is directed downwards and that rests on the leg 43*a* of the spring plate 43 and normally pushes it against the bottom 39*a* of the container. The pump housing also has a sleeve 49 that is arranged centrally and that co-operates with a bead 50 arranged at the bottom of the container in order to place the pump housing into the right position in the container part 39. Between the bottom side of the pump housing 44 and the bottom 39*a* of the container (and outside the inlet 46 of the pump and the bead 50) a porous filter mesh 51 is inserted.

The container 39 is partly covered by a rocker arm 52 having two dowels 53 that are supported for turning motion at the side walls 39*b* of the container. The front part of the rocker arm 52 supports a freely rotating roll 54 that abuts the conveyor belt 27 at its entire width. The motion of the conveyor belt 27 due to friction engagement creates a rotating motion of the roll 54. The roll 54 is eccentrically supported by the rocker arm 52 by means of a dowel 55 arranged at each side of the roll. The rear part of the rocker arm 52 rests against a push rod 56 that is surrounded by a coil spring 57. The push rod 56 serves as an activation means for the membrane pump 45. Thus, the tilting motion of the rocker arm 52 created by the roll 54 in turn creates a to-and-fro motion of the push rod 56, which then activates the membrane pump 45.

The container part 39 also has a channel 58 that is placed at each side of the rear roll 31 the channels extending forwards, upwards from the container at each side wall 39*b* such that liquid flowing from the belt drops down into the channel and is transported to the container.

Figure 2:
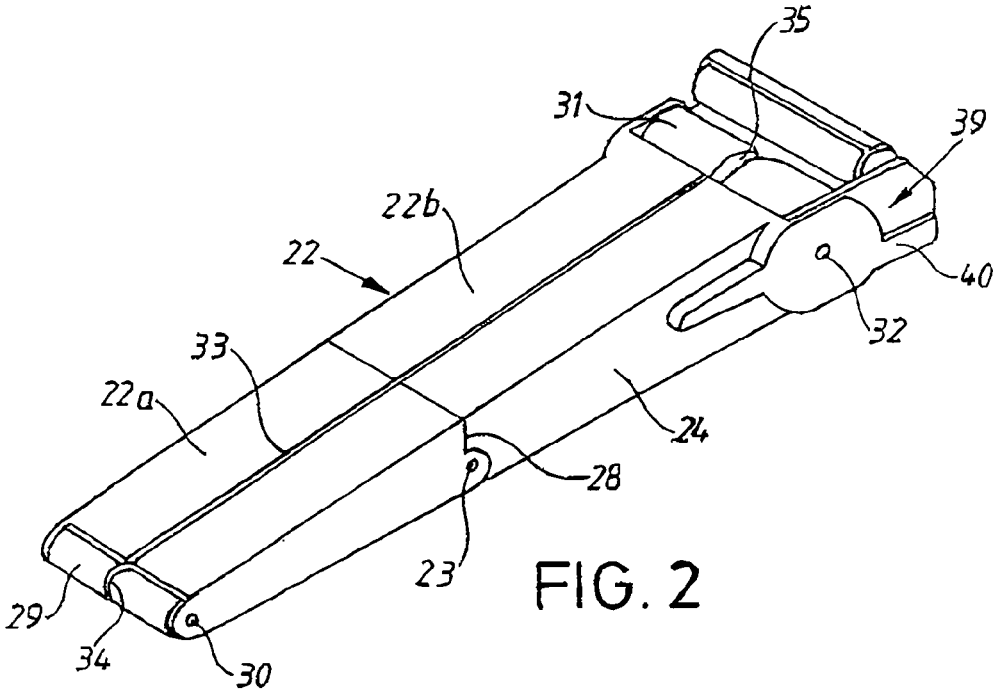
FIG. 2 is a perspective view of the lower portion of the apparatus without the conveyor belt that normally is arranged on it.

The device operates and is used in the following manner. The operator removes the first container 16 from the apparatus and the hose 20 and fills it with a suitable cleaning agent after which the container is again replaced on the apparatus. Then the operator starts the motor 36 by means of the control panel 18 and simultaneously applies cleaning liquid on the belt by means of the valve that is built into the container and via the hose 20 and the nozzles arranged below the bracket 15. The drive shaft 37 of the electric motor thereby transfers the drive force via the gear 38 to the rear roll 31 that drives the conveyor belt 27 counter-clockwise in FIG. 2 about the front roller 29 the conveyor belt being centered because its elongated ridge 27*c* runs in the grooves 33, 34 and 35. Hence, cleaning liquid will be applied on the surface by means of the conveyor belt 27 at the same time as dirt particles together with the liquid is transported up through the gradually narrowing gap between the conveyor belt and the front wall 39*c*. When the conveyor belt reaches up above the front wall 39*c* dirt particles and a part of the liquid will be removed from the belt by means of the portion of the leg 41*b* of the spring loaded scratching plate 41 that abuts the conveyor belt. When the belt continues to move upwards about the roll 31 the belt will get in touch with the roll 54 that then squeezes out the liquid which is contained in the belt. The major part of the liquid that is squeezed out flows down through the openings 41*c* in the scratching plate 41 and brings the dirt particles to the container whereas liquid also is collected from the edges of the belt and flows down into the container via the channels 58. Simultaneously the membrane pump 45 will operate since the roll 54, that is supported eccentrically and that is in friction engagement with the belt, rotates and thereby achieves a tilting motion of the rocker arm 52 that acts on the pump via the push rod 56. Thus, the liquid which is collected in the container flows through the filter 51 to the pump inlet 46 from which it flows further through the pump 45 and the check valve 47 through the hose 21 up to the dirty liquid container 17. When the cleaning has been finished the dirty liquid container 17 is removed and emptied of its content. If desired the conveyor belt 27 can be removed by folding down the front part 22*a* of the frame structure 22 with respect to the rear part 22*b*. After cleaning or replacing the belt the frame structure can be moved back to its normal position by again folding up the front part 22*a* such that the abutting surfaces 28 will touch each other.

It should in this connection be mentioned that the device is designed such that the components that are involved easily can be demounted and be cleaned. Thus, the container part 39 can easily be removed from the frame structure 22 by acting on the snap tongues 40. When a locking means, not shown, has been released, the rocker arm 52, the pump housing 44 with the check valve 47, the filter mesh 51 and the scratching plate 41 with the spring plate 43 can successively be lifted out from the container.

The apparatus according to the invention is very easy to handle since the electric motor pulls the apparatus in the forward direction which means that the operator easily can guide the apparatus in the desired direction by means of minimal manual efforts.

What is claimed is:

1. Portable surface treating apparatus comprising:

a shaft part (12) with a handle part (13), the handle part capable of guiding the apparatus on a surface to be cleaned;

a frame structure (22) having several rolls (29, 31) about which an endless conveyor belt (27) for liquid and dirt particles is arranged, wherein a portion of the belt between the rolls (29, 21) abuts the surface and is placed such that it is mainly parallel to the surface; and a scratching means (41) biased against the conveyor belt (27) and removing liquid and dirt particles from the belt, the scratching means comprises an L-shape having a longitudinal leg (41*a*) and a latitudinal leg (41*c*), the latitudinal leg (41*c*) includes at least one opening allowing for cleaning liquid (16) to be in fluid communication with a removable container part (39).

2. Apparatus according to claim 1, wherein the frame structure comprises a mainly flat wall portion (26) that the conveyor belt (27) abuts and that is mainly parallel to the surface.

3. Apparatus according to claim 1, wherein the frame structure is box shaped and encloses an electric motor (36) with a drive shaft (37) and a gear that transmits the driving motion of the drive shaft to at least one of the rolls (31).

4. Apparatus according to claim 1, wherein the frame structure supports a removable container part (39) in which liquid and dirt particles are collected.

5. Apparatus according to claim 1, wherein the frame structure (22) supports a rocker arm (52) that is provided with a roll (54) with an eccentric axis of rotation that is pressed against the conveyor belt (27), the conveyor belt rotates the roll, the rocker arm being connected to and driving a pump (45).

6. Apparatus according to claim 5, wherein the pump (45) is a membrane pump that is integrated with a pump housing (44) that is placed in a removable container part (39), the pump housing being provided with a liquid inlet (46) and a liquid outlet to which a check valve (47) is connected.

7. Apparatus according to claim 6, wherein a filter (51) is placed immediately before the liquid inlet.

8. Apparatus according to claim 1, wherein the frame structure comprises at least two parts (22*a*, 22*b*) that are turnable with respect to one another, wherein when the parts are aligned with one another, the at least two parts constitute a track for the conveyor belt (27), and wherein when the parts are angled with respect to one another, the conveyor belt is capable of being removed from the track.

9. Apparatus according to claim 1, wherein the conveyor belt comprises a support layer (27*b*) with an outer micro fibre layer (27*a*).

10. Apparatus according to claim 1, further comprising a removable container for cleaning liquid (16) and a removable collecting container (17) for dirty liquid, the container for cleaning liquid being connectable to a nozzle in order to directly or indirectly supply a cleaning liquid to the surface, and the removable collecting container for dirty liquid being arranged so that dirt particles and liquid removed from the belt will be brought to the removable collecting container.

11. Apparatus according to claim 1, wherein the scratching means (41) is rotatable about an axis that is parallel with the longitudinal leg (41*a*).

12. Apparatus according to claim 1, wherein the frame structure comprises at least two parts (22*a*, 22*b*) that are rotatable with respect to one another.

13. Apparatus according to claim 1, wherein the scratching means (41) is biased against the conveyor belt (27) by a spring plate (43).

14. Portable surface treating apparatus comprising:

a shaft part (12) with a handle part (13), the handle part capable of guiding the apparatus on a surface to be cleaned; and a frame structure (22) having several rolls (29, 31) about which an endless conveyor belt (27) for liquid and dirt particles is arranged, wherein a portion of the belt between the rolls (29, 21) abuts the surface and is placed such that the portion is mainly parallel to the surface, and wherein the frame structure is box shaped and encloses an electric motor (36) with a drive shaft (37) and a gear that transmits the driving motion of the drive shaft to at least one of the rolls (31); and a scratching instrument (41) having a leg (41*b*) biased against the conveyor belt (27) and removing liquid and dirt particles from the belt.

15. Apparatus according to claim 14, wherein the frame structure comprises a mainly flat wall portion (26) that the conveyor belt (27) abuts and that is mainly parallel to the surface.

16. Apparatus according to claim 14, wherein the frame structure supports a removable container part (39) in which liquid and dirt particles are collected.

17. Apparatus according to claim 14, wherein the scratching instrument (41) has an L-shape and further comprises a longitudinal leg (41*a*), and wherein the leg (41*b*) biased against the conveyor belt is a latitudinal leg (41*b*).

18. Apparatus according to claim 17, wherein the scratching instrument (41) is rotatable about an axis that is parallel with the longitudinal leg (41*a*).

19. Apparatus according to claim 17, wherein the scratching instrument (41) comprises at least one opening in the latitudinal leg (41*c*) allowing for cleaning liquid (16) to be in fluid communication with a container part (39).

20. Apparatus according to claim 14, wherein the scratching instrument (41) is biased against the conveyor belt (27) by a spring plate (43).

21. Portable surface treating apparatus comprising:

a shaft part (12) with a handle part (13), the handle part capable of guiding the apparatus on a surface to be cleaned;

a frame structure (22) having several rolls (29, 31) about which an endless conveyor belt (27) for liquid and dirt particles is arranged and at least two parts (22*a*, 22*b*) that are rotatable with respect to one another, wherein a portion of the belt between the rolls (29, 21) abuts the surface and is placed such that it is mainly parallel to the surface; and a scratching means (41) biased against the conveyor belt (27) and removing liquid and dirt particles from the belt.

* * * * *